US005985381A

United States Patent [19]

Conner

[11] Patent Number: 5,985,381

[45] Date of Patent: Nov. 16, 1999

[54] METHODS FOR INCREASING A CAMOUFLAGING EFFECT AND ARTICLES SO PRODUCED

[76] Inventor: Kyle Henry Conner, 211 Third St. South, Columbus, Miss. 39701

[21] Appl. No.: 09/201,316

[22] Filed: Nov. 27, 1998

Related U.S. Application Data

[63] Continuation-in-part of application No. 08/885,412, Jun. 30, 1997, Pat. No. 5,846,614.

[51] Int. Cl.[6] ..... F41H 3/00

[52] U.S. Cl. ..... 428/15; 156/272.2; 428/17; 428/919; 430/2; 430/336

[58] Field of Search ..... 156/272.2; 428/15, 428/17, 919; 430/2, 336

[56] References Cited

U.S. PATENT DOCUMENTS

| | | | |
|---|---|---|---|
| 3,808,024 | 4/1974 | Witman | 428/203 X |
| 4,205,988 | 6/1980 | Ozaki et al. | 428/919 X |
| 4,220,708 | 9/1980 | Heller | 428/919 X |
| 4,838,965 | 6/1989 | Bussard | 428/79 X |
| 4,933,991 | 6/1990 | Love | 428/100 X |
| 5,133,088 | 7/1992 | Dunlap | 428/187 X |
| 5,438,192 | 8/1995 | Kaplan et al. | 428/919 X |
| 5,653,166 | 8/1997 | Mohammed et al. | 428/138 X |
| 5,846,614 | 12/1998 | Conner | 428/15 |

*Primary Examiner*—Henry F. Epstein
*Attorney, Agent, or Firm*—Kenneth E. Darnell

[57] ABSTRACT

Methods and articles so produced for increasing the camouflaging effect of any camouflaging pattern, the invention relates to the coating of at least portions of a camouflaging pattern disposed on an article with a material capable of assuming different chromic states at different ambient light levels. Materials employed to produce color changes in the camouflaging pattern include light and/or heat sensitive dyes and/or inks and particularly photochromic materials capable of reversible color changes. At least portions of camouflaging patterns modified according to the invention change color, such as from a color in the original camouflaging pattern to a different color or from a first shade of a given color to a second shade of that same color, on exposure to sunlight either of a more direct nature or a greater intensity, the color change being reversed in whole or in part by a return of ambient light conditions toward or to a given set of original light conditions. Color changes can also be from a clear "no color" state to a colored state. Since lighting conditions, especially direct sunlight, can cause thermal changes, materials capable of reversible alteration in chromic state due to heat changes also find utility in the methods of the invention.

18 Claims, 4 Drawing Sheets

METHODS FOR INCREASING A CAMOUFLAGING EFFECT AND ARTICLES SO PRODUCED

CROSS-REFERENCE TO RELATED APPLICATION

This application is a continuation-in-part of U.S. patent application Ser. No. 08/885,412, filed Jun. 30, 1997 now U.S. Pat. No. 5,846,614, by the same inventor.

BACKGROUND OF THE INVENTION

1. Field of the Invention

The invention relates generally to methods for camouflaging articles including articles of clothing and the like and to camouflaging patterns, the invention relating particularly to methods and articles so produced for increasing the camouflaging effect of a camouflaging pattern by changing the chromic state of materials forming at least some of the camouflaging pattern on exposure to changing ambient light conditions.

2. Description of the Prior Art

Camouflage is an art unintentionally but advantageously employed in nature to conceal by pattern and/or color. Mankind learned basic camouflaging techniques from natural sources long prior to recorded history in order to conceal human beings, their possessions and even dwellings from human enemies as well as from animals being hunted or possibly hunting human beings. In more recent times, camouflage has been commonly employed in sport hunting and in military situations, these differing applications sharing a common intent of concealing people, clothing, armament and other accessories through the use of patterns and color which cause the concealed entities to merge with a given background. Camouflaging patterns presently in use vary widely but usually involve representations of natural structure taken from a given environment with which the hunter intends to blend. Such structure includes vegetative materials in particular, whether as individual leaves, stems, branches or the like or vegetative groupings which can be representative of one or more bushes, trees, etc. These patterns are often colored with a number of different colors depending upon the background with which a particular pattern is intended to blend. Such patterns are typically formed by the screening of individual colors in succession on a substrate such as a textile substrate. Even when a variety of colors are employed in an original printed camouflaging pattern of this kind, the color intensity and color type does not change to produce an improved camouflaging effect when the camouflaging pattern is exposed to increased ambient light conditions such as occurs, for example, when the sun comes out from behind a cloud. In prior art camouflaging patterns, the reflective capacities or capabilities of the colors forming portions of the camouflaging pattern do not change since a given color in the camouflaging pattern remains that color regardless of ambient lighting conditions. Given this characteristic of prior art camouflaging patterns, it is readily seen that such prior art patterns do not allow for changes in the colors forming the pattern when the pattern is exposed to increased lighting levels such as are primarily due to changing sunlight conditions. Even more clearly, prior art camouflaging patterns do not provide for changes in the patterns themselves when the pattern is exposed to increasing levels of sunlight. Essentially, except for possible minor changes in color shading brought about by reflectivity only when a prior art camouflaging pattern is exposed to increased ambient light levels, the prior art does not encompass in its teachings a change in a camouflaging effect, much less an improvement in a camouflaging effect brought about by differing ambient light conditions and particularly sunlight exposure levels. In effect, prior art camouflaging patterns remain essentially the same regardless of sunlight intensity.

Photochromic materials are well known in a variety of arts and include light and/or heat sensitive dyes and/or inks both inorganic and organic including polymeric materials, microencapsulated materials and paints inter alia, which materials can be solvated in water-based or other solvents. A characteristic common to photochromic materials is the ability to change chromic state between at least two different light levels. A chromic state is that color condition, including a colorless condition, which exists at a given light level or levels. As an example, a photochromic dye can be essentially colorless at ambient light conditions such as would exist indoors out of direct sunlight but would change to a colored state when exposed to increased ambient lighting conditions such as direct sunlight and/or when exposed to increased heat levels. Photochromic dyes such as "chromasome inks" are particularly available which exhibit colorless chromic states at ambient lighting conditions such as would exist indoors out of direct sunlight but which change chromic state to a colored condition when exposed to direct sunlight, these dye materials having previously been used in articles of apparel such as "T" shirts and the like to produce a colored pattern on the article of clothing when the wearer is in direct sunlight but which "disappears" when the article of apparel is worn indoors in normal indoor ambient light conditions. As such, the prior utility of photochromic dyes and inks of this type has been to produce a highly visible and recognizable pattern on an article of apparel when that article of apparel is exposed to direct sunlight, such articles of apparel and the patterns thus formed thereon being the literal opposite of camouflage since such prior art patterns are intended to be seen.

The present invention intends the provision of methods and articles produced by the methods for increasing the camouflaging effect of any camouflaging pattern by virtue of coating of at least portions of the camouflaging pattern with a photochromic material capable of different chromic states under differing ambient light levels. The camouflaging patterns produced according to the invention are intended to change color and even shape due to color change and when the patterns are exposed to differing ambient light levels and particularly to direct sunlight as opposed to indirect sunlight. Still further, the invention intends the formation of "shadows" and the like in a camouflage pattern such as in areas of the pattern not previously colored or not previously bearing indicia, the shadowing being formed as representational of the manner in which shadows are formed in nature. The invention therefore intends an improvement in camouflaging effect for articles provided with a camouflage pattern produced according to the invention.

SUMMARY OF THE INVENTION

The invention provides methods for increasing a camouflaging effect in a camouflaging pattern as well as articles produced according to the methods of the invention. In a preferred method of the invention, a photochromic material is coated over at least portions of a camouflaging pattern, the photochromic material being capable of different chromic states at different ambient light levels. In particular, a preferred photochromic material so employed exhibits a colorless chromic state when subjected to ambient light levels such as are encountered in indoor environmental situations or outdoors such as when direct sunlight is absent or obscured by shading structures and the like. The preferred photochromic materials, when exposed to direct sunlight or to substantially increased ambient light levels, then exhibit a change to a chromic state causing a color change in the photochromic material. When the photochromic material is disposed over a colored material in the camouflaging pattern, the color of the material in the camouflaging pattern can combine with the color of the photochromic material in the chromic state so produced to provide an additive color function, that is, the colors of the original camouflaging pattern and of the photochromic material printed thereover can produce a color change of a desirable nature which acts to increase the camouflaging effect of the original camouflaging pattern, this increased camouflaging effect being particularly suitable to the increased light level conditions which are brought about by exposure to direct sunlight, etc. On return of ambient light levels to or toward original conditions, the photochromic material changes color to the original chromic state which, in the case of certain preferred photochromic materials disclosed herein, is to a colorless chromic state. Preferred photochromic materials according to the invention are therefore seen to be reversible.

A variety of photochromic materials can be useful according to the invention to include light-sensitive and/or heat-sensitive materials capable of color changes and particularly reversible color changes, these materials including both inorganic and organic materials including polymeric materials, microencapsulated materials and paints inter alia. Photochromic dyes useful according to the invention can be formulated to exist in a "sol" or similar dispersion. Aqueous solutions of photochromic materials useful according to the invention can also be formulated. Photochromic materials useful according to the invention can exhibit color changes from colorless to colored states, from "lighter" colors and shades to "darker" colors and shades or from "darker" colors and shades to "lighter" colors and shades. It is to be understood that this variety of material choice is referred to herein through the use of the single term "photochromic materials" even though particular photochromic materials are explicitly disclosed herein in descriptions of the preferred embodiments of the invention.

According to the invention, photochromic materials are coated over particular portions of an existing camouflage pattern and particularly along edges of structure within the pattern such as, in a representation of vegetative matter in a pattern, the edges of representations of leaves, stems, branches, stalks, trunks, vegetative masses and borders therebetween which are representative of structure within the existing pattern. In an existing camouflage pattern which is improved according to the invention, at least certain representational portions of the camouflaging pattern can be formed of conventional inks or similar materials which are incapable of color change. Those portions of the existing camouflaging pattern which are coated with particular photochromic dye-containing ink as described herein either do not exhibit a color change or only a relatively minor color change at ambient light levels such as exist indoors during daylight hours or which exist outdoors such as during periods when the sun is behind clouds or blocked by natural or man-made shading structure. However, exposure to the sun or the like of the camouflaging pattern having photochromic overcoating causes the photochromic overcoating to substantially change color or hue, the color of the photochromic material causing a color change in at least a portion of the pattern which was previously colored or causing a color change in at least a portion of the pattern which was not colored or colored only as background. The newly colored area, which can take a representational shape such as a shadow or the like, produces a colored area in the camouflaging pattern which is more effectively camouflaging under conditions of increased light levels such as direct sunlight. An existing camouflaging pattern per se is possibly capable of producing a perceived increase in brightness or reflective intensity on exposure to ambient lighting levels of greater intensity such as direct sunlight. However, the existing camouflaging pattern per se will only exhibit a nominally increased reflectivity and does not change color to a color or hue capable of providing an increased camouflaging effect for a given light level.

When utilizing photochromic materials which are colored at different chromic states, the photochromic material can be used to form particular portions of a camouflaging pattern either with or without overcoating portions of an existing camouflaging pattern. In such a situation, the photochromic material is conveniently employed not only at the edges of representations of vegetative structure in the pattern but also in the bodies thereof to form entire representations of structure such as entire leaves, stems, branches, stalks, trunks and other vegetative masses as well as shadows of such structure. Similarly, photochromic materials can be coated over or can form at least some or all of a camouflaging pattern including major portions of at least certain structure including representations of leaves, stems, stalks, branches, trunks, vegetative masses and borders therebetween as well as shadows of such structures. Photochromic materials of differing chromic states can be coated over or form at least some or all of representational structure forming a camouflaging pattern including representation of leaves inter alia.

Accordingly, the invention provides camouflaging patterns and methods for forming such patterns wherein colors within the pattern change on exposure to sunlight or ambient lighting levels of increased intensity, the color change being similar to the color change of environmental background colors including formation of shadows when exposed to lighting of increased intensity such as direct sunlight.

It is another object of the invention to provide methods and articles so produced for increasing the camouflaging effect of any camouflaging pattern through the formation of at least portions of the camouflaging pattern from a photochromic material or from overprinting of a photochromic material onto existing portions of a camouflaging pattern to increase the camouflaging effect of the pattern, thereby increasing the versatility and effectiveness of the camouflaging pattern.

It is a further object of the invention to provide methods for increasing a camouflaging effect and articles so produced of a camouflaging pattern by changing the chromic state of materials forming at least some or all of the camouflaging pattern on exposure to changing ambient lighting conditions.

Further objects and advantages of the invention will become more readily apparent in light of the following detailed description of the preferred embodiments.

BRIEF DESCRIPTION OF THE DRAWINGS

FIG. 5A is a front elevational view of a planar representation of a leaf structure such as exists in camouflaging patterns, the leaf structure representation having areas of differing color such as exist under conditions of relatively low ambient lighting such as when the sun is obscured by a cloud or the like;

DESCRIPTION OF THE PREFERRED EMBODIMENTS

Figure 1:
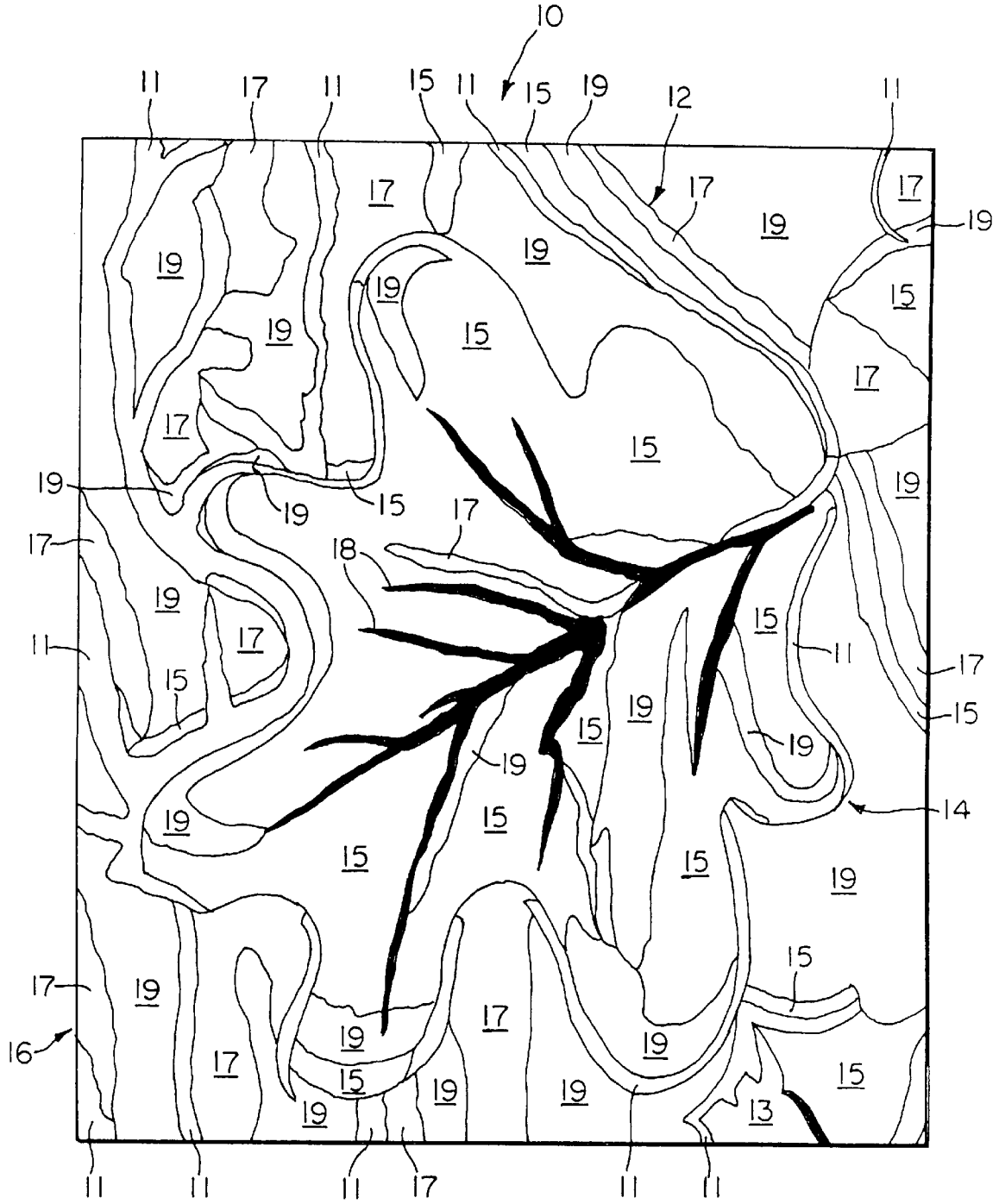
FIG. 1 PRIOR ART
FIG. 1 is a front elevational view of a planar portion of a prior art camouflaging pattern formed of a number of differing colors.

Referring now to the drawings and particularly to FIG. 1, a portion of an original camouflaging pattern is seen at 10 to comprise a representation of a branch 12, a representation of a leaf 14, a representation of a trunk 16 of a tree and representations of veins 18 of the leaf 14. A camouflaging pattern such as the portion of such a pattern seen at 10 utilizes a variety of shapes and colors to produce a concealing function. Colors employed for various areas of the pattern 10 include tans, blacks, white, browns, golds, greens and grays inter alia. Differing areas of the pattern 10 are differently colored in order to produce a camouflaging effect. Representations of structure such as the representation of the branch 12 can be seen to have various areas thereof colored differently. In the example of the branch 12, two different areas of said branch 12 are colored gray as indicated by the numeral 17 while the remaining portion of the branch 12 is colored brown as indicated by the numeral 15. For camouflaging effect, and to provide an impression of coloring in nature, a representation of structure such as the branch 12 is typically colored more than one color. Although the areas of differing color as seen in FIG. 1 are seen to be separated by black lines due to the fact that FIG. 1 is a line drawing, in actual practice some areas of the pattern 10 would not have a black line disposed therebetween. In such situations, one color would simply end and the other color begin. Still further, a camouflaging pattern such as the pattern 10 would have in certain other areas a blending of the colors together such as where one color fades into an adjacent area of different color.

The pattern 10 has been simplified as to number of colors and as to the size of areas of differing color as well as the number of differing colored areas in close proximity to each other. For an example, "wisps" of the color gray shown as 17 can be placed in the pattern 10 within larger areas of color such as the large areas which are colored with brown as seen at 15. The "wisps" of lighter color serve to break up areas of darker colors, in particular, and provide a more natural camouflaging effect. It is also seen in the pattern 10 that the color black as seen at 11 can be used to form relatively large areas of color as well as to provide relatively narrow lines between areas of different color. It should also be understood that lines between areas of different color can also be provided by other colors such as brown as an example of a darker color and gray as an example of a lighter color. The color green seen at 13 is typically provided within a pattern as coloring a relatively large area. The colors green 13, brown 15, gray 17, and tan 19 can further be appreciated to have a wide variety of hues or shades within the same pattern 10. As might be appreciated from a consideration of the pattern 10, camouflaging patterns can be infinitely diverse in shape and color. According to the present invention, these camouflaging patterns of infinite diversity can be improved according to the present invention as will be described herein.

It is known in the art that a camouflaging pattern such as the pattern 10 is advantageously formed by the successive printing, such as by screening, of the different colors onto a substrate which is typically a woven or non-woven textile fabric although virtually any surface can receive a printed camouflaging pattern onto its surface. According to the present invention, at least portions of the pattern 10 of FIG. 1 are coated such as by overprinting with photochromic materials which, when exposed to ambient light of sufficient intensity such as direct sunlight, changes color to produce a different color which is intended to be representative of the coloring effect produced in nature and which occurs during a substantial change in ambient lighting conditions. Such a color change can result from a combining of the "new" color of the photochromic material within the color present in the original camouflaging pattern 10 or can result from the change of the photochromic material from one state to a second state including from a colorless state to a colored state. Changes in ambient lighting conditions in nature often occur such as when the sun moves from behind a cloud and exposes objects to direct sunlight as opposed to a lower level of ambient light existing when the sun is behind clouds or other shading structure. The colors of the original camouflaging pattern 10 do not change color when exposed to direct sunlight and the colors, shades and hues which can be seen in the pattern 10 can only become slightly brighter since the reflective capacity and capability of a given colored area of the pattern 10 does not change due to an increased illumination level. However, placement of a photochromic material over some or all or even portions of some or all of the areas of the pattern 10 marked as being gray by the numeral 17, for example, results according to the invention in a change in color of those areas so coated on exposure to substantially increased illumination levels such as exposure to direct sunlight. In the instance where the photochromic material is colorless at low illumination levels, the gray 16 in the pattern 10 is colored solely due to the contribution of the ink forming the original pattern 10. On exposure to direct sunlight, for example, the overcoated photochromic material changes chromic state and becomes a color characteristic of the particular photochromic material. The color then perceived for the overcoated area is, in general, the additive contribution of the color of the area, such as a gray area 17, with the color of the photochromic material when exposed to sunlight. The pattern 10 would then exhibit a different pattern of color due to the change thus effected.

Photochromic materials having a colorless state when exposed to low light conditions can be coated either over colored portions of a normal pattern 10 or over uncolored portions of the pattern 10. Exposure to sunlight or the like can then cause a representation of structure of a representation of the existence of structure, such as a shadow, to form in the enhanced pattern. Such a shadow can be caused to "form" over uncoated or coated portions of a normal pattern such as the pattern 10 or both.

Figure 2:
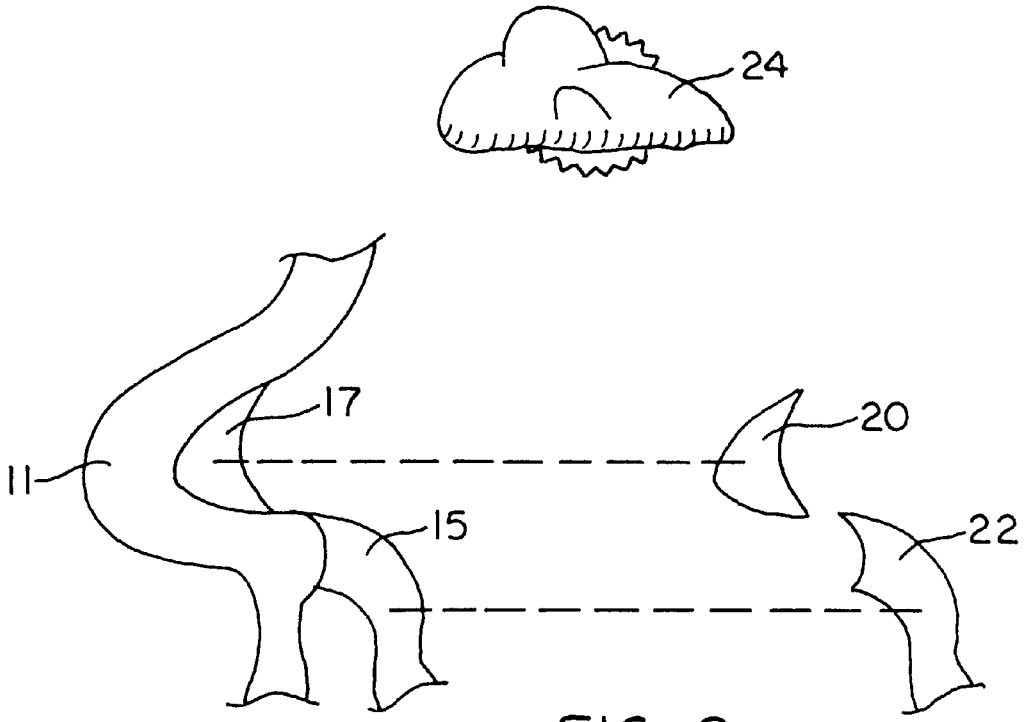
FIG. 2 is an idealized detail perspective view of a portion of FIG. 1 and having an overcoating of a photochromic material which is to be applied to at least portions of the camouflaging pattern and shown in exploded relation to the camouflaging pattern, the clear and colorless overcoating layer of photochromic material being seen as colorless under ambient lighting conditions such as do not include direct sunlight or its equivalent.
Figure 3:
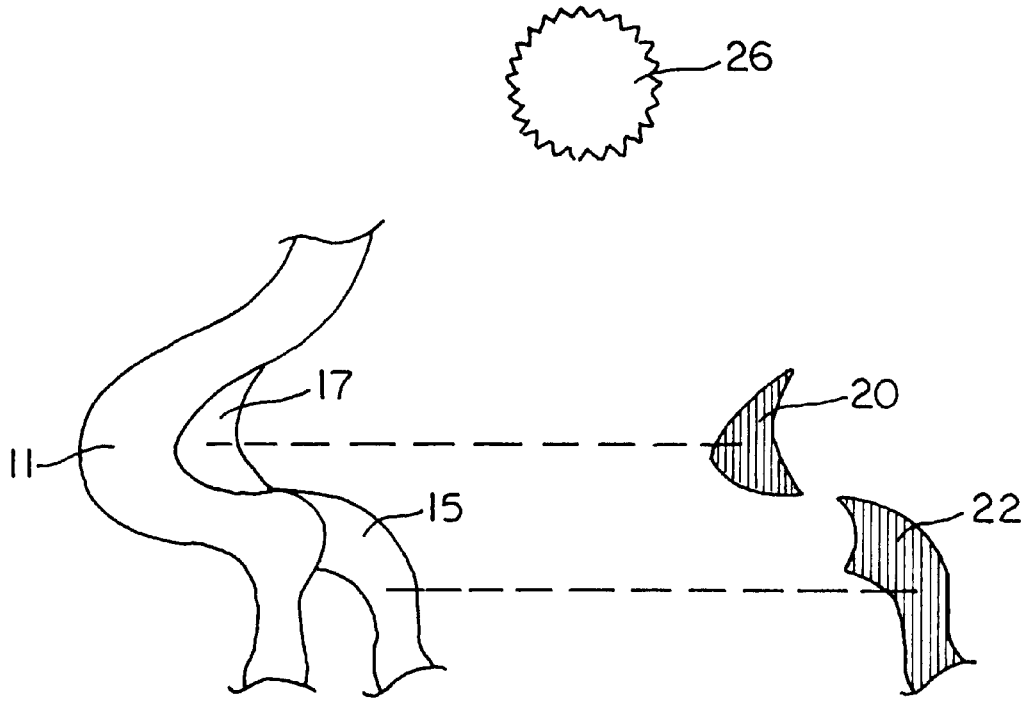
FIG. 3 is an idealized detail perspective view such as is seen in FIG. 2 but illustrating the change in color of the photochromic material overcoat due to exposure to direct sunlight.
Figure 4:
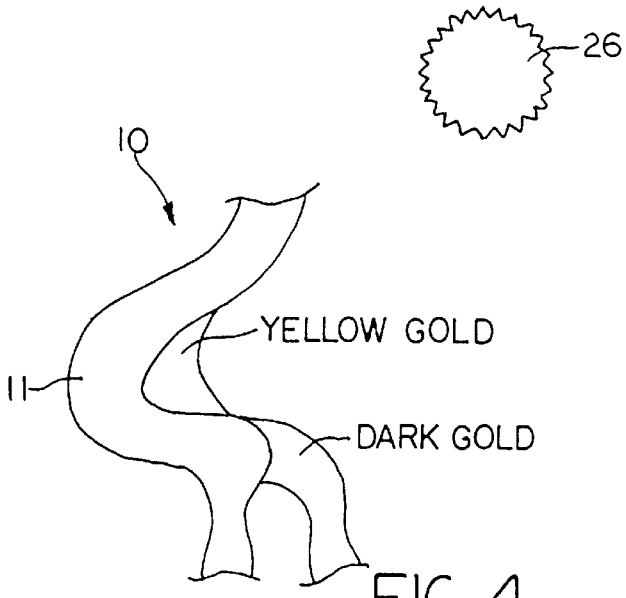
FIG. 4 is a front elevational view of the representation of FIG. 3 when the portion of the original camouflaging pattern and the overcoat are disposed in contacting relation such that the colors thereof are additive to produce a color different from the color of either layer taken singly.

While photochromic materials of widely varying color can be applied to a camouflaging pattern such as the pattern 10 to produce color changes of differing kind and degree, reference is now made to FIGS. 2 through 4 in order to more clearly illustrate the effect of the application of a typical photochromic material useful according to the invention to a localized portion of a camouflaging pattern such as the pattern 10. FIGS. 2 and 3 represent a particular portion of a camouflaging pattern taken from the pattern 10, that portion being identical in FIGS. 2 and 3. The localized pattern of FIGS. 2 and 3, as well as FIG. 4, comprises an area of a black color as seen at 11, an area of a gray color as seen at 17, and an area of a brown color as seen at 15. Shown in "exploded" relation to the gray area 17 and the brown area 15 are identically shaped layers 20 and 22 which are shaped respectively to fit over the gray area 17 and the brown area 15, the representation of FIGS. 2 and 3 being idealized in the showing of a very thin layer of coating material, that is, the layers 20 and 22 of photochromic dyestuff, as it would "ideally" exist in spaced relation to the portions of the pattern 10.

As seen in FIG. 2, relatively low ambient lighting conditions prevail due to the fact that the sun is illustrated as being blocked out by clouds 24. Under these relatively low ambient lighting conditions, the layers 20 and 22 of "red" dye are colorless. The portion of the pattern 10 seen in FIG. 2 would therefore appear to be the same color as in FIG. 1 since no color contribution is provided by the layers 20 and 22. Note, however, in FIG. 3, that the emergence of sun 26 to expose the pattern 10 to direct sunlight causes the layers 20 and 22 to become red as is indicated by the vertical hatching on the layers 20 and 22. Of course, the layers 20 and 22 are perceived as being red only in the idealized situation where the layers 20 and 22 are spaced from the pattern 10 or in the more realistic situation where the photochromic red dye comprising the layers 20 and 22 had been placed on a "white" substrate such that the only color contribution would be from the layer 20 and 22. With further reference to FIG. 4, however, it is seen that exposure to the sun 26 causes that area previously seen as gray at 17 to change color and become a yellow/gold color due to the additive contribution of the original gray color 17 and the red color from the layer 20 of photochromic material. Similarly, the area of the pattern 10 seen in FIGS. 2 and 3 as being brown at 15 is now seen in FIG. 4 to be a dark gold due to the additive color contributions of the brown color from the original camouflaging pattern 10 and the red color from the layer 22 of the photochromic material.

While the representations provided in FIGS. 2 through 4 are greatly simplified and pertain particularly to photochromic materials which are colorless under relatively low ambient lighting levels and colored only on exposure to relatively higher ambient lighting levels such as direct sunlight, it is to be seen that even for such particular photochromic materials, literally infinite combinations exist for color change in an original camouflaging pattern such as the pattern 10 when some or all of the pattern 10 is overcoated with photochromic materials. Given the teachings of the invention, it is even possible for the designer of camouflaging patterns to design the original pattern itself around the various photochromic materials suitable to practice of the invention in order that the photochromic materials are used to best advantage. In a usual practice of the invention, photochromic materials are preferably placed in lighter areas of the pattern 10 which not only allow for greater color change but which also provide more definition to the lighter areas in the pattern 10 which mimics nature due to increased definition of structure in nature when exposed to direct sunlight or the like. Using photochromic dyestuffs in ink formulations such as will be described hereinafter, it is generally advantageous to change greens and browns in original patterns to yellows and oranges in the patterns improved according to the invention. Dyestuffs which turn red from a colorless original form will change relatively large light areas such as gray areas or "white" areas to a red color on exposure to sunlight. The browns in a camouflaging pattern are usually of differing intensity and range between lighter milk chocolates to darker milk chocolates. A red dyestuff on a darker milk chocolate base will result on exposure to sunlight in a dark gold color while a red dyestuff on a lighter milk chocolate will produce a yellow gold color. Combinations of coloring can also be provided which will cause certain camouflaging patterns to be more useful in the spring of the year while other camouflaging patterns will find greater utility in the fall of the year.

Figure 5A:
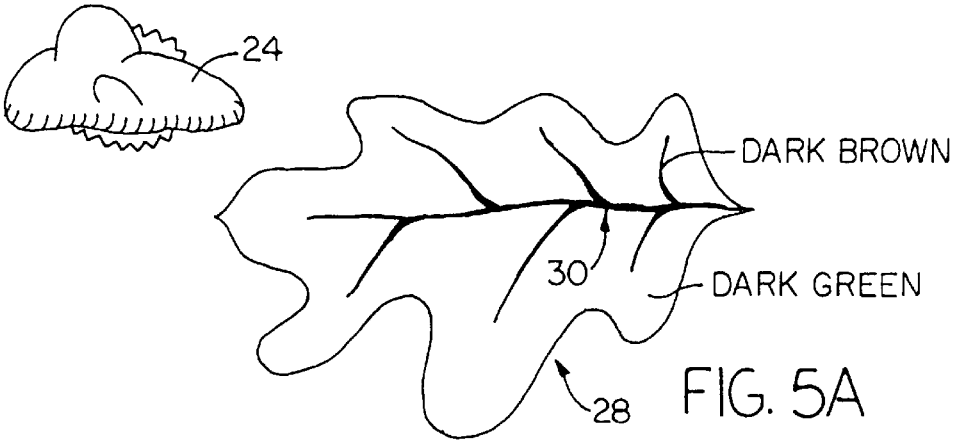
Figure 5B:
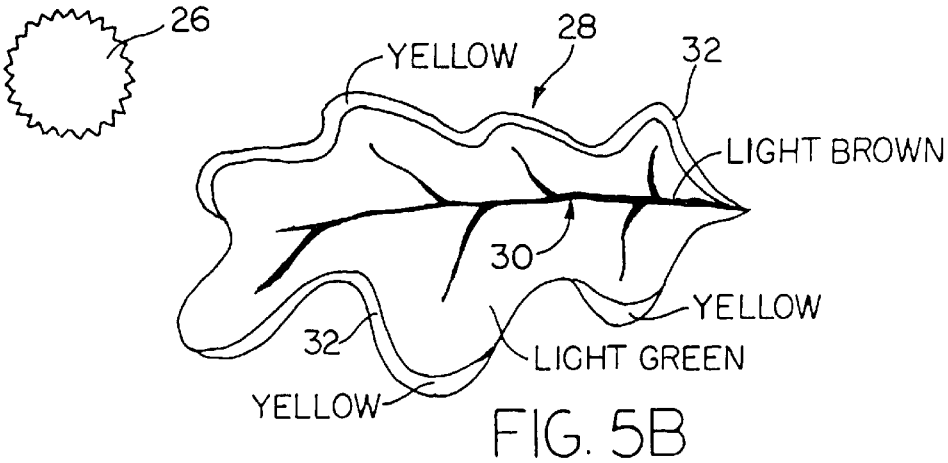
FIG. 5B is identical to FIG. 5A with the exception that the representational structure is exposed to direct sunlight and shows differing colors in the areas in which the original colors are illustrated in FIG. 5A.

Photochromic materials vary in the nature of the color change exhibited when exposed to sunlight or the like. Certain photochromic materials including certain materials preferred at present due to ability to rapidly change color, etc., typically cause a camouflaging pattern to change from relatively lighter colors to relatively darker colors. In such situations, gray areas of a pattern as well as white to off-white areas are typically more favorably coated with photochromic material since darker areas in an original pattern will typically only darken. Photochromic materials capable of changing from darker colors to lighter colors of the same color would be advantageously utilized according to the showing of FIGS. 5A and 5B. In FIG. 5A, a leaf 28 is seen to be formed of a dark green color in the body of the leaf 28, the leaf further having dark brown veins 30. FIG. 5A illustrates relatively low ambient lighting conditions. Under increased ambient lighting conditions such as exposure to direct sunlight as represented by FIG. 5B, portions of the dark green areas of the leaf 28 change to a lighter green whereas edges of the leaf 28 as seen at 32 become a yellow color. The veins 30 change from a dark brown to a lighter brown. Color changes as can be appreciated from a comparison of FIG. 5A with FIG. 5B illustrate color changes found in nature such as when the sun moves out from behind a cloud, it being the intent of the invention to produce similar color changes which are as natural as possible in order to provide an increased camouflaging effect.

Figure 6:
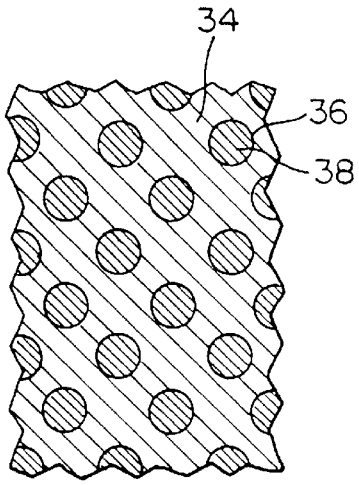
FIG. 6 is a front elevational view of a planar portion of a camouflaging pattern illustrating a representational structure such as a leaf wherein fractional tone areas are disposed within the body of a representational structure so that the fractional tone area can be overcoated with a material which changes color on exposure to direct sunlight or equivalent increased ambient lighting levels.

When photochromic materials suitable to particular camouflaging opportunities are not readily available or are too expensive for commercial consideration, the invention envisions the use of fractional tones such as illustrated simply in FIG. 6 to provide desired camouflaging effects. In FIG. 6, a greatly enlarged portion of structure found in a camouflaging pattern is conveniently taken to be a portion of a leaf or the like wherein major portions seen at 34 of a leaf or the like are caused to be "full tone" which could conveniently be a relatively dark green color such as might be representative of a leaf or other vegetation. A multiplicity of small white dots 36 are caused to be formed throughout the portions 34, these dots 36 being printed as half tones, quarter tones or other fractional tones with photochromic material in order to provide an ovcerall lighter color on exposure to sunlight. The coloration of the fractionally toned pattern seen in FIG. 6 thus moves from a darker color under ambient lighting conditions of a relatively low level to a lighter color on exposure to direct sunlight or substantially higher ambient lighting conditions. As one example, the dots 36 can be essentially light or of a gray color such as the gray 17 in the pattern 10. Overcoating of the "gray" dots 36 with a suitable photochromic dye material causes the gray dots 36 to become gold on exposure to sunlight, thereby improving and increasing the camouflaging effect of the pattern.

Particular photochromic materials which are presently known to be advantageously utilized in the practice of the invention include aryl-substituted heterocyclic photochromic dyestuffs such as are produced under the trade name Reverasacol and made available by the Keystone Aniline Corporation of Chicago, Ill. The Reverasacol materials take the form of dry dye powders which are converted to ink formulations by companies such as Flexible Products, Inc. of Marietta, Ga., and Color Technologies, Inc., of Watkinsville, Ga. These photochromic dyes are substantially colorless under relatively low ambient lighting conditions but change variously to blues, greens, reds, oranges, purples and yellows when exposed to sunlight or other high ambient lighting conditions. The Reverasacol dyes are soluble in polymers and various solvents and can be used in differing percentages to form color combinations in both resin and binder formulations. Formulations can be provided for adherence to substrates formed of essentially any material. Combination of these photochromic dyes with ordinary dyes and/or pigments is also possible and within the scope of the invention.

The dyestuffs referred to above can be formulated as inks in aqueous, that is latex, based formulations and in oil formulations to produce inks applicable by ordinary silk-screening methods and similar known methodology. Clear plastisol printing inks, such as available from the 3-G Corporation, Morristown, Tenn., are available for mixing with dyestuffs. Certain of the plastisol inks allow addition of the dyestuffs under normal agitation with percentages of the dyestuffs as a part of the total formulation typically ranging from 0.1% to 2%. Concentrations of PBC printing inks into which the dyestuffs can be incorporated allow modification of hardness and flexibility of the resulting ink by additions of plasticizers such as DINP. Latex printing inks incorporating the present dyestuffs can also be provided by flat screen printing, rotary screen printing, roller printing and ink jet printing inter alia. In latex formulations, the dyes are predispersed into an aqueous solution typically comprising 70% water, 25% dyestuff, 1% surfactant such as Synthropol KB manufactured by ICI Chemicals and 4% thickener such as ASE-60 manufactured by Rhome and Hauss Chemical along with sufficient ammonia to neutralize pH. The dye solution thus formed is mixed to make a ready to use ink with a binder such as Orco Pad Binder HLF, from Orco Dyestuffs Corp. and a thickener such as Orco Clear Conc. 331, from Orco Dyestuffs Corporation. A typical solution includes 20% binder, 75% thickener and 5% of the dye solution formulated above.

A coating suitable for plastic and metals is formulated using 35% of an acrylic resin such as B-66 from Rhom & Haas, 8.75% toluene, 42.2% xylene, from 12 to 14% PM acetate and 0.1 to 2% of the dyestuff formulation. While these particular formulations are very useful, it is to be understood that other formulations of photochromic materials including the dyestuffs particularly disclosed above are useful in the practice of the invention.

Figure 7:
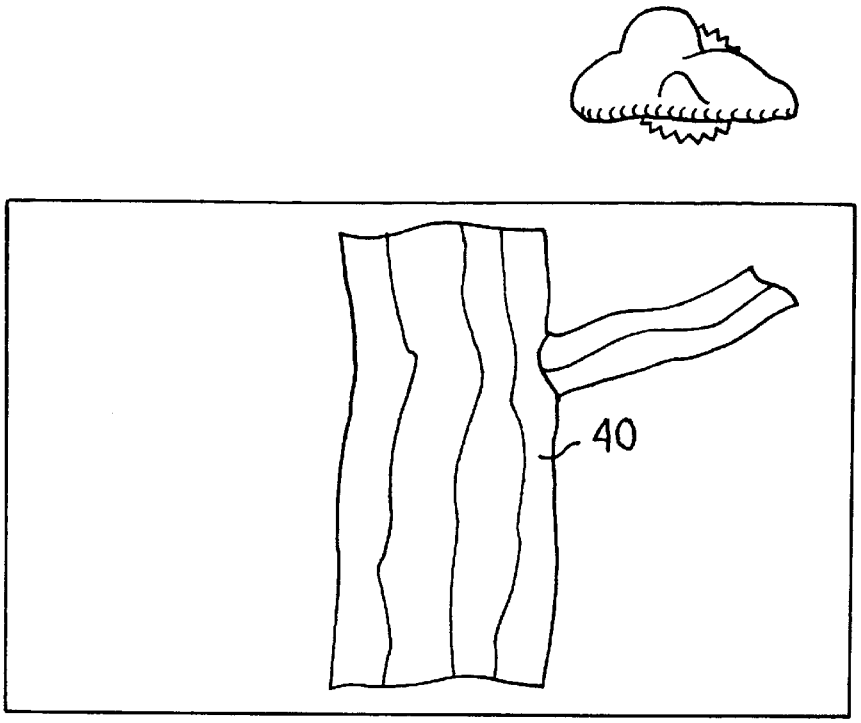
FIG. 7 is an idealized detailed perspective view of a portion of a camouflage pattern; and, FIG. 8 is the pattern of FIG. 7 on exposure to sunlight.
Figure 8:
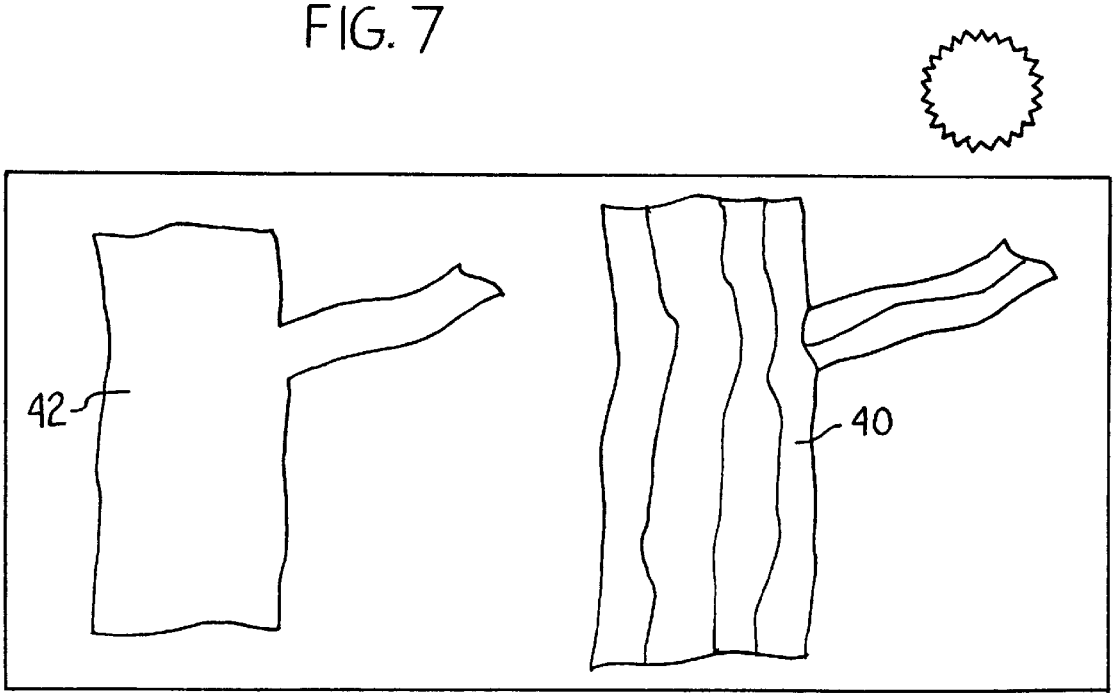

Referring now to FIGS. 7 and 8, a portion of a camouflage pattern is seen to comprise a representation 40 of a tree trunk or the like under relatively low ambient light conditions such as would exist when the sun is obscured by a cloud or the like. As seen in FIG. 7, the representation 40 of the tree trunk does not cast a shadow or casts only a very faint shadow (not seen in the drawing). However, when the sun seen at 44 in FIG. 8 is no longer obscured by a cloud or other obscuring structure, it is seen in the pattern of FIG. 8 that a representation 42 of a shadow is formed. The representation 42 of the shadow forms by virtue of having previously coated an area of the camouflage pattern with a clear and colorless photochromic material which, on exposure to direct sunlight or the like as described herein, causes an area of the camouflage pattern to change color to a gray, brown or other darker color to mimic the formation of a shadow as occurs in nature. The photochromic material which causes formation of the representation 42 of the shadow can be overcoated onto any portion of the camouflage pattern including areas of the pattern previously coated with ink materials or portions of the pattern not previously coated with ink materials or both. It should also be understood that the camouflage pattern represented in FIGS. 7 and 8 would likely have a number of different shadow representations which would form on exposure to sunlight or the like. It is also apparent that the formation of shadows as described in combination with other increased camouflaging effects as described herein can all take place on the same camouflage pattern in order to increase the camouflaging effect of the pattern when exposed to direct sunlight or the like.

Photochromic materials solvated by organic solvents or by water-based solvents including water per se are commonly available. Examples of such materials which change from a clear, colorless state to virtually any visible color are referred to in U.S. Pat. No. 5,730,961, the disclosure of which is incorporated hereinto by reference. Photochromic materials described in U.S. Pat. No. 5,730,961 include spiropyrans and spiroxazines.

A wide variety of suitable photochromic materials are available and include those photochromic materials described in the following U.S. Pat. Nos.:

| | |
|---|---|
| 5,176,905 | 5,591,255 |
| 5,435,994 | 5,630,869 |
| 5,446,150 | 5,708,181 |
| 5,456,905 | 5,728,758 |

The disclosures of the patents thus listed are incorporated hereinto by reference.

Suitable photochromic materials compounded in suitable solvents for printing as particularly intended according to the invention can be obtained from sources such as GSR Enterprises, 561 Buckeye Court, Santa Rosa, Calif. 95409; and from $2_{nd}$ Story Concepts, 975 Higbee Avenue, N.W., Canton, Oh. 44718. Aqueous-based materials particularly suited for printing on fabrics can be obtained from $2_{nd}$ Story Concepts particularly as materials which change from clear to yellow, blue, red or gray and which can be compounded by mixing to provide virtually any color of the spectrum.

The invention also encompasses the addition of materials known as puffing agents to the photochromic inks used to form at least a portion of a camouflaging pattern. Such puffing agents typically take the form of fine particles of resinous materials such as polystyrene and the like, such materials and processes for use of such materials being disclosed in U.S. Pat. Nos. 4,933,991; 5,133,088 and 5,653,166, the disclosures of which patents are incorporated hereinto by reference. According to the invention, the puffing agents could be added to both photochromic inks and conventional inks, if both kinds of inks are present in a pattern, although the puffing agent would not necessarily be present in all portions of the pattern. A puffing agent could potentially be added only to a portion of a given color, either photochromic or conventional, when such color portions are contiguous in order to provide shadowing or other effects.

Processing according to the invention when using puffing agents includes typical heating steps and the like which can essentially be that methodology disclosed in the patents referred to above, photochromic inks useful according to the invention as described hereinabove having thermal stability characteristics similar to those of conventional inks used in forming camouflage patterns, these thermal stability characteristics allowing ready use of puffing agents. It is further to be understood that puffing agents can be used as taught herein in camouflage patterns printed solely with conventional, non-photochromic inks.

The invention further encompasses the concepts of inclusion of holograms and the like in a camouflage pattern, such holograms being produced according to U.S. Pat. Nos. 3,808,024 and 4,838,965, the disclosures of which arc incorporated hereinto by reference, and by other techniques known in the industry. Essentially, the invention extends to the use of either or both photochromic inks and conventional inks in the formation of a hologram, the hologram then being preferably used in a camouflage pattern. However, it is to be understood that a hologram pattern formed in part or wholly with photochromic inks could be utilized for the formation of printed patterns other than camouflage patterns. It is further to be seen that puffing agents can be used in those inks utilized to form holograms for inclusion in camouflage patterns or the like according to the invention. Processing steps necessary to formation of such holograms and application thereof to fabrics and the like are described in the aforesaid patents since these techniques are useful with photochromic inks in a manner similar to use of conventional inks due to heat stability and other characteristics of the photochromic inks which are similar to corresponding characteristics of conventional inks used for formation of holograms used to form patterns on fabrics and the like.

While the invention has been particularly described in reference to the formation of camouflaging patterns on textile fabrics and the like, it is to be understood that the camouflaging patterns of the invention can be directly formed onto a variety of substrates in addition to fabrics utilized for formation of clothing and the like. Examples include direct formation of the camouflaging patterns onto weaponry, optical equipment, vehicles, buildings including hunting blinds and the like, aircraft, watercraft, as well as small accessories including knives, bottles, and communication equipment inter alia. Photochromic materials other than chromasome ink based materials in differing base compositions and providing a variety of color change options find utility according to the invention. While light sensitive dyes find particular utility according to the invention, it is to be understood that liquid crystalline material and other photochromic materials find utility according to the invention. Accordingly, it is believed to be apparent that the invention is to be interpreted in light of the following recitation of the invention as provided in the appended claims.

What is claimed is:

1. A method for producing shadows in a camouflage pattern on exposure of the pattern to high ambient light levels such as direct sunlight in order to increase the camouflaging effect of the pattern, comprising the steps of:

forming a photochromic material onto a portion of the pattern at which a shadow is to appear on exposure to said light levels, the portions of the pattern being configured to be representational of a shadow formed by a representation of structure in the pattern, the photochromic material having a first chromic state under a first set of ambient, relatively lower light conditions, the photochromic material having a second chromic state under a second set of ambient, relatively higher light conditions; and, subjecting the pattern to the second set of ambient light conditions.

2. The method of claim 1 wherein the second set of ambient light conditions includes direct sunlight.

3. The method of claim 1 wherein the first chromic state of the photochromic material is colorless and the second chromic state of the photochromic material is colored.

4. The method of claim 3 wherein the color of the portion of the pattern having the photochromic material formed thereon under the second set of ambient light conditions is gray.

5. The method of claim 1 wherein different portions of the pattern have photochromic materials formed thereon capable of different color or hue changes.

6. The method of claim 1 wherein the pattern has structural representations of objects formed in the pattern, the method further comprising the step of forming edges of at least certain of said objects of a relatively light color, the photochromic material being formed on at least portions of said relatively light-colored edges.

7. A camouflaging pattern capable of increased camouflaging effect on exposure to light levels such as direct sunlight, the increased camouflaging effect being due at least in part to formation of shadows in the pattern on exposure to said light levels, comprising areas of the pattern formed of at least one color or differing hues of a color, and photochromic material formed onto at least portions of the pattern, the photochromic material having a first chromic state under a first set of ambient, relatively lower light conditions and a second chromic state under a second set of ambient, relatively higher light conditions, the photochromic material forming at least one shadow being formed on the pattern at a location representational of a shadow formed by a representation of structure in the pattern.

8. The camouflaging pattern of claim 7 wherein the second set of ambient light conditions includes direct sunlight.

9. The camouflaging pattern of claim 7 wherein the first chromic state of the photochromic material is colorless and the second chromic state ofthe photochromic material is colored.

10. The camouflaging pattern of claim 9 wherein the color of the portion of the pattern having the photochromic material formed thereon under the second set of ambient light conditions is gray.

11. The camouflaging pattern of claim 7 wherein different portions of the pattern have photochromic materials capable of different color or hue changes formed thereon.

12. The camouflaging pattern of claim 7 wherein the pattern has structural representations of objects formed in the pattern, edges of at least certain of said objects being formed of a relatively lighter color and the photochromic material being formed on at least portions of said relatively light-colored edges.

13. A method for enhancing the camouflaging effect of a camouflage pattern on exposure of the pattern to high ambient light levels such as direct sunlight, comprising the steps of:

adding a puffing agent to a photochromic ink having a first chromic state under a first set of ambient, relatively lower light conditions and a second chromic state under a second set of ambient, relatively higher light conditions;

forming the photochromic ink onto at least a portion of the pattern; and, subjecting the pattern to the second set of ambient light conditions.

14. The method of claim 13 wherein the camouflage pattern is formed of photochromic inks and conventional inks, the puffing agent being added to one or both of the inks.

15. A method of enhancing the camouflaging effect of a camouflage pattern on exposure of the pattern to high ambient light levels such as direct sunlight, comprising the steps of:

forming a hologram on a substrate, the hologram including a photochromic ink forming at least a portion thereof, the photochromic ink having a first chromic state under a first set of ambient, relatively lower light conditions and a second chromic state under a second set of ambient, relatively higher light conditions; and, subjecting the pattern to the second set of ambient light conditions.

16. The method of claim 15 wherein at least a portion of the photochromic ink includes a puffing agent.

17. A method of forming a decorative pattern on a substrate, comprising the steps of:

forming a hologram on the substrate, the hologram including a photochromic ink forming at least a portion thereof, the photochromic ink having a first chromic state under a first set of ambient, relatively lower light conditions and a second chromic state under a second set of ambient, relatively higher light conditions; and, subjecting the pattern to the second set of ambient light conditions.

18. The method of claim 17 wherein at least a portion of the photochromic ink includes a puffing agent.

* * * * *